US005711324A

United States Patent [19]

Johnson et al.

[11] Patent Number: 5,711,324

[45] Date of Patent: Jan. 27, 1998

[54] HAIR DRYING CURLER APPARATUS

[75] Inventors: Lonnie G. Johnson, Smyrna, Ga.; Francis E. LeVert, Knoxville, Tenn.; John Applewhite, Atlanta, Ga.

[73] Assignee: Johnson Research & Development Co., Inc., Atlanta, Ga.

[21] Appl. No.: 639,143

[22] Filed: Apr. 29, 1996

[51] Int. Cl.[6] ..... A45D 6/16

[52] U.S. Cl. ..... 132/252; 132/245; 132/251; 34/95

[58] Field of Search ..... 132/252, 251, 132/226, 227, 221, 220, 245; D28/37; 34/95, 96

[56] References Cited

U.S. PATENT DOCUMENTS

| | | | |
|---|---|---|---|
| 2,129,121 | 9/1938 | De Duke | 132/252 |
| 2,533,958 | 12/1950 | Root et al. | 132/220 |
| 2,646,053 | 7/1953 | Harris | 132/41 |
| 2,919,494 | 2/1960 | Runci | 34/95 |
| 3,109,437 | 11/1963 | Broyles | 132/9 |
| 3,175,562 | 3/1965 | Reed | 132/251 |
| 3,415,255 | 12/1968 | Mitsumoto | 132/151 |
| 3,656,490 | 4/1972 | Grossman | 132/221 |
| 3,682,181 | 8/1972 | Garrett | 132/31 |
| 3,693,635 | 9/1972 | Garrett | 132/33 |
| 3,902,508 | 9/1975 | Sliman | 132/40 |
| 4,041,961 | 8/1977 | Shaler et al. | 132/221 |
| 4,526,184 | 7/1985 | Caruso | 132/39 |
| 4,603,706 | 8/1986 | Caruso | 132/251 |
| 4,958,648 | 9/1990 | Morey | 132/220 |
| 5,297,567 | 3/1994 | Summerville et al. | 132/227 |
| 5,299,367 | 4/1994 | Johnson et al. | 132/221 |

FOREIGN PATENT DOCUMENTS

| | | | |
|---|---|---|---|
| 907426 | 3/1946 | France | 132/221 |
| 1206938 | 9/1970 | United Kingdom | 132/252 |

*Primary Examiner*—Gene Mancene
*Assistant Examiner*—Philogene Pedro
*Attorney, Agent, or Firm*—Kennedy, Davis & Kennedy

[57] ABSTRACT

A hair drying curler apparatus (10) for curling and drying a lock of hair is disclosed having a tubular roller (11) and a retaining clip (12). The roller has a tubular support (14), a moisture permeable inner cover material (15) joined to a moisture permeable outer cover material (16), and a mass of hair drying expediting material (18) positioned between the inner and outer cover materials. The outer cover material is quilted to form a linear array of generally axially aligned, annular channels (22) containing the expediting material. Similarly, the retaining clip has a support (26), a moisture permeable inner cover material (27) joined to a moisture permeable outer cover material (28), and a mass of hair drying expediting material (30) positioned between the inner and outer cover material. The outer cover material is quilted to form a linear array of arcuate channels (33) containing the expediting material.

21 Claims, 2 Drawing Sheets

HAIR DRYING CURLER APPARATUS

TECHNICAL FIELD

This invention relates to hair drying curler apparatuses, and more particularly to hair drying curler apparatuses using a hair drying expediting material.

BACKGROUND OF THE INVENTION

Hair treating devices are well known in the form of rollers which are typically cylindrical and sized so that a lock of hair may be wound thereabout for curling and drying purposes. Such rollers have been made from a variety of material and have been used for both professional and home-use hair treatments.

Since the advent of such devices, means have been sought for accelerating the drying of wet hair on the rollers and for obtaining a curl having enhanced characteristics of softness and permanence. The acceleration of drying with hair rollers has been accomplished by dryers which force heated air over the hair. These hair dryers typically come in the form of an air circulating bonnet or a portable hair drying. Both device however limit the movement of the person utilizing such as they both require a connection to an electrical outlet to energize them.

Hair drying rollers have also been previously proposed as a means for drying hair simultaneously with other treatments such as curling, waving, body building and the like. Such apparatuses usually are provided with a heat retaining member within the roller which is heated prior to use. The heat retaining member may be heated by immersing the roller into heated liquid or by electrically heating it with a heating element.

Rollers have also been designed having a desiccant material, such as silica gel, activated alumina and activated charcoal, therein which causes an exothermic reaction which generates heat, as shown in U.S. Pat. No. 3,175,562 and 3,415,255. Once wet hair is wrapped about the roller the moisture within the hair is absorbed by the desiccant material thereby causing an exothermic reaction which creates heat that dries the hair. The desiccant material of these rollers however are typically formed as a solid. With this construction the area of desiccant material exposed to moisture is limited to its exterior surface. This greatly reduces the capacity of the roller in absorbing moisture and producing heat. Desiccant material rollers have also been designed having a hollow roller body in which is positioned clay pellets having silicate embedded therein. The clay however limits the exposure of the silicate and therefore its function. Another problem associated with this hollow interior design roller is that the pellets naturally gather within the bottom portion of the roller interior. Hence, the top portion of the roller does not have the same absorbing and heating capacity as compared to the lower portion. This can cause the uneven drying and curling of the hair. Should the pellets be tightly packed into the interior to establish a generally uniform consistency only the outermost pellets would absorb moisture, similar to the solid roller previously described.

Desiccant material roller have also been designed having a high surface area material such as hook and loop type fastener material to which silica gel is adhered, as shown in U.S. Pat. No. 5,299,467 which was invented by the present inventor herein. It has been discovered however that the surface of the silica gel to which the adhesive is applied does not absorb moisture, and thus again the efficiency of the silica gel is limited.

Accordingly, it is seen that a need remains for a hair drying curler which can evenly, thoroughly, and efficiently dry hair without confining the movement of the wearer. It is to the provision of such therefore that the present invention is primarily directed.

SUMMARY OF THE INVENTION

In a preferred form of the invention a hair drying curler apparatus for use in drying and curling locks of damp hair comprises a curler roller having a curler body, a layer of moisture permeable material mounted about the curler body to form a cavity therebetween, and a mass of free-flowing, granular hair drying expediting material positioned within the cavity for flowing movement therein. The hair drying curler apparatus also has retaining means mountable to the curler roller for retaining a lock of hair wrapped about the curler roller. With this construction a lock of damp hair wrapped about the curler roller is dried by the action of the expediting material therein.

DETAILED DESCRIPTION

Figure 1:
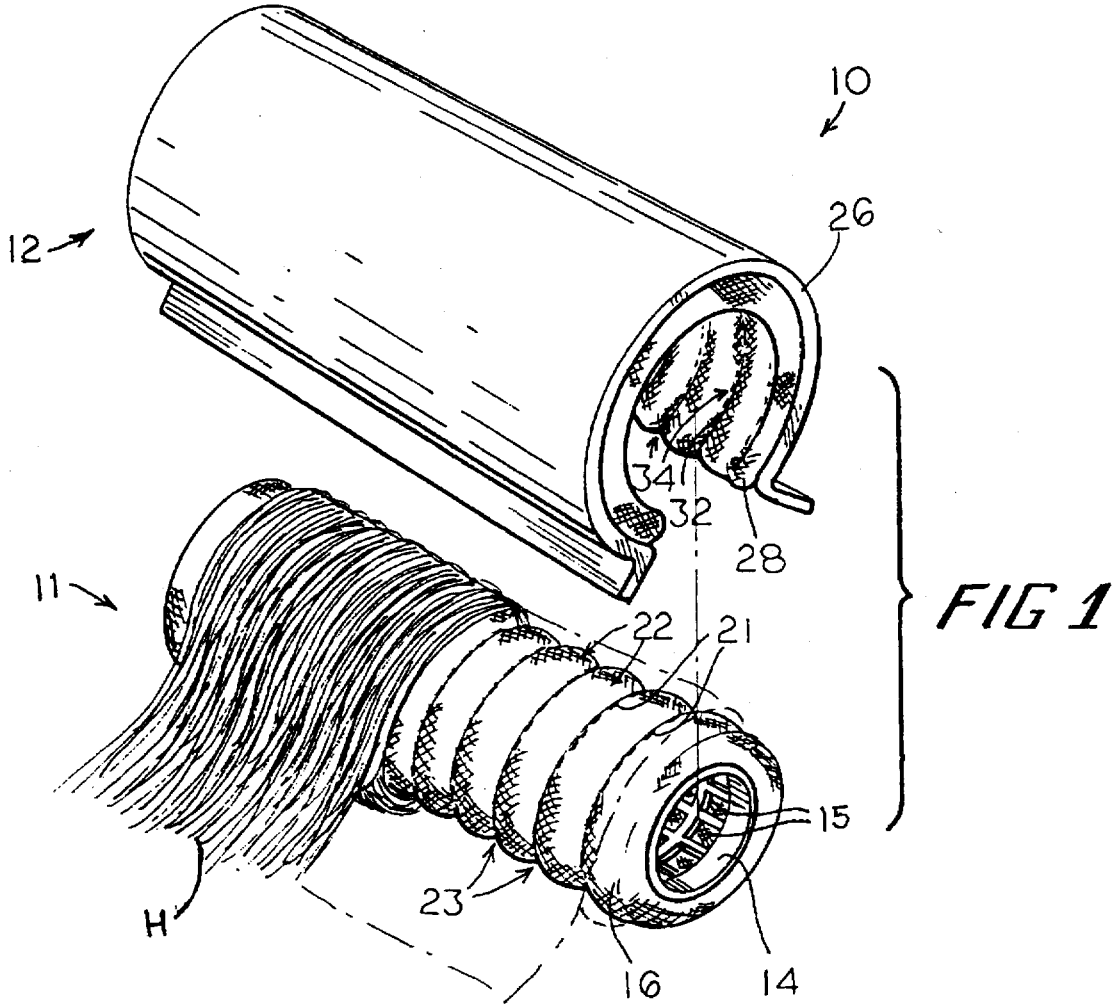
FIG. 1 is an exploded, perspective view of a hair drying curler apparatus embodying principles of the invention in a preferred form.

With reference next to the drawings, there is shown a hair drying curler apparatus 10 for curling and drying a lock of hair. The hair drying curler apparatus has a tubular roller 11 and a retaining clip 12.

The roller 11 has a tubular, perforated body portion or support 14, a moisture permeable inner cover material 15 mounted about the support 14, a moisture permeable outer cover material 16 overlaying the inner cover material 15 and joined thereto about its periphery so as to form a pocket 17 therebetween, and a mass of hair drying expediting material 18 positioned within the pocket 17. The outer cover material 16 is generally quilted by stitches 21 to form a linear array of generally axially aligned, annular channels 22 and an array of exterior crevices 23. The hair drying expediting material 18 is preferably a material which causes an exothermic reaction when subjected to moisture, such as for example silica gel, activated alumina and activated charcoal.

The retaining clip 12 has an omega-shaped outer shell or support 26, a moisture permeable inner cover material 27 mounted to the inner surface of the support 26, a moisture permeable outer cover material 28 overlaying the inner cover material 27 and joined thereto about its periphery so as to form a pocket 29 therebetween, and a mass of hair drying expediting material 30 positioned within the pocket 29. Again, the hair drying expediting material 30 is preferably that which causes an exothermic reaction when subjected to moisture. The outer cover material 28 is generally quilted by stitches 32 to form a linear array of arcuate channels 33 and an array of inwardly facing crevices 34.

Figure 2:
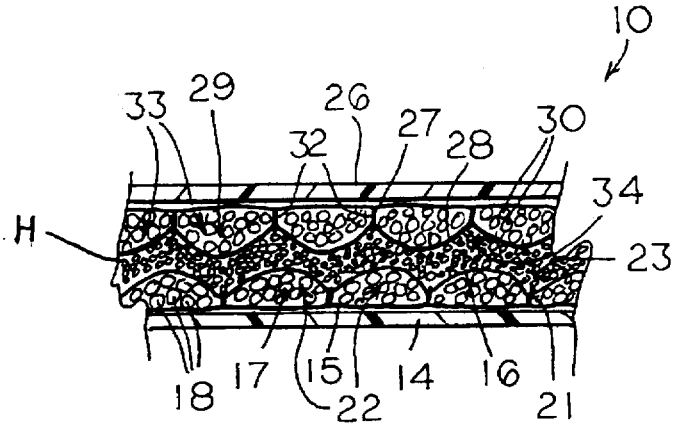
FIG. 2 is a partial, longitudinal cross-sectional view of the hair drying curler apparatus of FIG. 1 with a lock of hair therein.

The inner and outer cover materials of both the tubular roller 11 and the retaining clip 12 are preferably made of conventional silk screening material having a 300 dot count, i.e. 300 interstices per linear inch. This material density will prevent small fragments of the hair drying expediting material from being dispersed from the roller pocket and accidently ingested by a user or child but yet allows moisture to readily pass therethrough. This is a desired featured as it is known that material such as silica gel oftentimes cracks as it absorbs moisture. In use, the hair of a user is typically washed in preparation for the hair treatment. A lock of hair H is then wrapped about the roller 11 until it is adjacent the scalp of the user's head. The retaining clip 12 is then snapped over the curler roller 11 and the hair H such that the lock of hair is pressed tightly between the outer cover material 16 of the roller 11 and the outer cover material 28 of the retaining clip 12. As shown in FIG. 2, the hair H naturally follows the contour of the outer cover material of the roller and retaining clip.

The hair drying expediting material 18 and 30 of the roller 11 and retaining clip 12, respectively, commences to absorb moisture from the lock of hair through their overlying outer covering materials. The absorption of moisture into the expediting material causes an exothermic reaction which creates heat that speeds the drying of the hair. In several minutes, the lock of hair is dry such that its rolled shape is set. The retaining clip 12 is then removed so as to release the lock of hair from the roller.

It should be understood that the undulating configuration of the outer covering increases its surface area of the outer cover material of the roller and retaining clip, thus allowing more hair to be exposed along the outer covering materials and subsequently to the expediting material thereunder as compared to the smooth surfaces of the prior art. This allows the hair to be dried quicker. Also, this configuration tends to reduce clumping of the hair by separating the lock. This reduces the chances of the hair drying uneven due to the different thicknesses of the lock of hair associated with clumps. Most importantly however, the forming of the channels 22 and 33 allows the expediting material to be positioned about the supports 14 and 26 in a manner which substantially prevents it from gravitationally falling or congregating in the lowermost portion of the pocket, yet which allows the free flowing movement of the expediting material so as to maximize exposure of it to moisture. In other words, the expediting material is maintained about the tubular support 14 in a manner which allows moisture to permeate the mass such that the entire mass absorbs moisture rather than merely the outer surface of the mass. The tubular configuration of the roller also allows moisture to reach the expediting material through the inner cover material.

Figure 3:
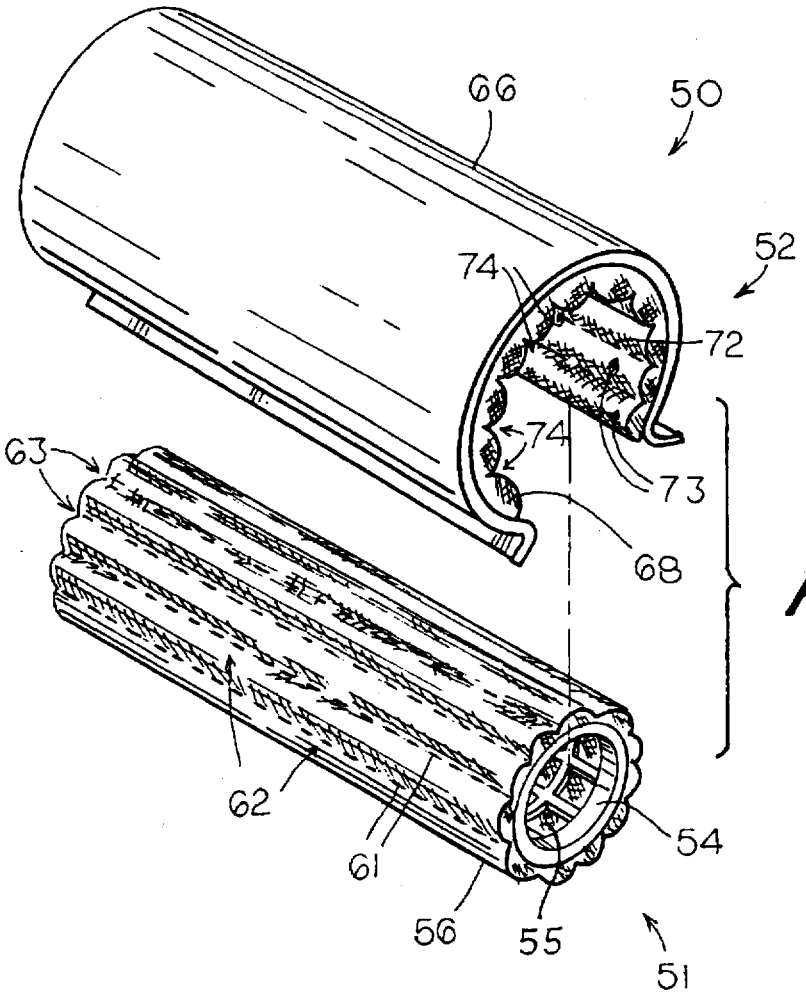
FIG. 3 is an exploded, perspective view of a hair drying curler apparatus embodying principles of the invention in another preferred form.
Figure 4:
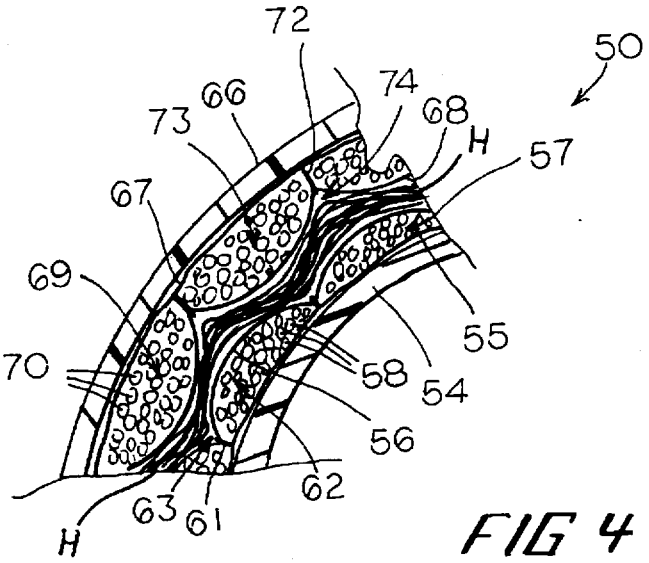
FIG. 4 is a partial, lateral cross-sectional view of the hair drying curler apparatus of FIG. 3 with a lock of hair therein.

With reference next to FIGS. 3 and 4, there is shown a hair drying curler apparatus in another preferred form. Here, the construction of the curler apparatus is essentially the same as previously describe except that the roller outer cover material and the retaining clip outer cover material are quilted longitudinally, as described in more detail hereinafter. The hair drying curler apparatus 50 has a tubular roller 51 and a retaining clip 52.

The roller 51 has a tubular roller body or support 54, a moisture permeable inner cover material 55 mounted about the support 54, a moisture permeable outer cover material 56 overlaying the inner cover material 55 and joined thereto about its periphery so as to form a pocket 57 therebetween, and a mass of hair drying expediting material 58 positioned within the pocket 57. The outer cover material 56 is generally quilted by stitches 61 to form an annular array of elongated channels 62 and an array of exterior crevices 63. Again, the hair drying expediting material 58 is preferably a material which causes an exothermic reaction when subjected to moisture, such as for example silica gel, activated alumina and activated charcoal.

The retaining clip 52 has an omega-shaped, perforated outer shell or support 66, a moisture permeable inner cover material 67 mounted to the inner surface of the support 66, a moisture permeable outer cover material 68 overlaying the inner cover material 67 and joined thereto about its periphery so as to form a pocket 69 therebetween, and a mass of hair drying expediting material 70 positioned within the pocket 69. Once again, the hair drying expediting material 70 is preferably that which causes an exothermic reaction when subjected to moisture. The outer cover material 68 is generally quilted by stitches 72 to form an arcuate array of generally linear channels 73 and an array of inwardly facing crevices 74.

The inner and outer cover materials of both the tubular roller 51 and the retaining clip 52 are preferably made of conventional silk screening material having a 300 dot count, i.e. 300 interstices per linear inch, for the same reasons as previously stated.

In use, the hair of a user is typically washed in preparation for the hair treatment. A lock of hair H is then wrapped about the roller 51 until it is adjacent the scalp of the user's head. The retaining clip 52 is then snapped over the curler roller 51 and the hair H such that the lock of hair is pressed tightly between the outer cover material 56 of the roller 51 and the outer cover material 68 of the retaining clip 52. As shown in FIG. 4, the hair H naturally follows the contour of the outer cover material of the roller and retaining clip.

The hair drying expediting material 58 and 70 of the roller 51 and retaining clip 52, respectively, commences to absorb moisture from the lock of hair through their overlying outer covering materials. The absorption of moisture into the expediting material causes an exothermic reaction which creates heat that speeds the drying of the hair. In several minutes, the lock of hair is dry such that its rolled shape is set. The retaining clip 52 is then removed so as to release the lock of hair from the roller.

It should be understood that here too the undulating configuration of the outer covering allows more hair to be exposed along the outer covering material to the expediting material thereunder as compared to the smooth surfaces of the prior art. This also allows the hair to be dried quicker. Most importantly however, the forming of the channels 62 and 73 allows the expediting material to be positioned about the supports 54 and 66 in a manner which prevents it from gravitationally congregating in the lowermost portion of the roller, yet allows the free flowing movement of the expediting material within the channel so as to maximize exposure of it to moisture. With the channels aligned in this manner the treated hair receives what is commonly known in the trade as a crimped look. It should also be understood that the outer shell of the retaining clip may also be perforated to allow moisture to be absorbed therethrough. While this invention has been described in detail with particular references to the preferred embodiments thereof, it should be understood that many modifications, additions and deletions, in addition to those expressly recited, may be made thereto without departure from the spirit and scope of the invention as set forth in the following claims.

We claim:

1. A hair drying curler apparatus for use in drying and curling locks of damp hair, comprising, a curler roller having a curler body, a layer of moisture permeable material mounted about said curler body to form a cavity therebetween, and a mass of free-flowing, granular hair drying expediting material positioned within said cavity for flowing movement therein; and retaining means mountable to said curler roller for retaining a lock of hair wrapped about said curler roller, whereby a lock of damp hair wrapped about the curler roller is dried by the action of the expediting material therein.

2. The hair drying curler apparatus of claim 1 wherein said curler roller is tubular.

3. The hair drying curler apparatus of claim 1 wherein said curler roller cavity is configured to form a generally annular array of elongated channels.

4. The hair drying curler apparatus of claim 1 wherein said curler roller cavity is configured to form a generally linear array of axially aligned, annular channels.

5. The hair drying curler apparatus of claim 1 wherein said layer of moisture permeable material envelopes said mass of granular hair drying expediting.

6. The hair drying curler apparatus of claim 1 wherein said retaining means comprises a retaining clip adapted to be releasably mounted about said curler roller.

7. The hair drying curler apparatus of claim 6 wherein said retaining clip comprises an outer shell, a layer of moisture permeable material mounted to said outer shell to form a clip cavity therebetween and a mass of free-flowing, granular hair drying expediting material positioned within said clip cavity for flowing movement therein.

8. The hair drying curler apparatus of claim 7 wherein said retaining clip cavity is configured to form a generally linear array of arcuate channels.

9. The hair drying curler apparatus of claim 7 wherein said retaining clip cavity is configured to form a generally arcuate array of elongated channels.

10. The hair drying curler apparatus of claim 9 wherein said curler roller cavity is configured to form a generally annular array of elongated channels.

11. The hair drying curler apparatus of claim 8 wherein said curler roller cavity is configured to form a generally linear array of axially aligned, annular channels.

12. A hair drying curler apparatus for use in drying and curling locks of damp hair, comprising, a generally tubular curler roller having an outer layer of moisture permeable material and an interior cavity;

a mass of free-flowing, granular hair drying expediting material positioned within said curler roller cavity for flowing movement therein; and retaining means mountable to said curler roller for retaining a lock of hair wrapped about said curler roller, whereby a lock of damp hair wrapped about the curler roller is dried by the action of the expediting material therein.

13. The hair drying curler apparatus of claim 12 wherein said curler roller cavity is configured to form a generally annular array of elongated channels.

14. The hair drying curler apparatus of claim 12 wherein said curler roller cavity is configured to form a generally linear array of axially aligned, annular channels.

15. The hair drying curler apparatus of claim 12 wherein said layer of moisture permeable material envelopes said mass of granular hair drying expediting.

16. The hair drying curler apparatus of claim 12 wherein said retaining means comprises a retaining clip adapted to be releasably mounted about said curler roller.

17. The hair drying curler apparatus of claim 16 wherein said retaining clip comprises an outer shell, a layer of moisture permeable material mounted to said outer shell to form a clip cavity therebetween and a mass of free-flowing, granular hair drying expediting material positioned within said clip cavity for flowing movement therein.

18. The hair drying curler apparatus of claim 17 wherein said retaining clip cavity is configured to form a generally linear array of arcuate channels.

19. The hair drying curler apparatus of claim 17 wherein said retaining clip cavity is configured to form a generally arcuate array of generally elongated channels.

20. The hair drying curler apparatus of claim 19 wherein said curler roller cavity is configured to form a generally annular array of elongated channels.

21. The hair drying curler apparatus of claim 18 wherein said curler roller cavity is configured to form a generally linear array of axially aligned, annular channels.

* * * * *